US005174739A

United States Patent [19]

Kim

[11] Patent Number: 5,174,739

[45] Date of Patent: Dec. 29, 1992

[54] SCROLL-TYPE COMPRESSOR WITH ECCENTRICITY ADJUSTING BUSHING

[75] Inventor: Joong H. Kim, Seoul, Rep. of Korea

[73] Assignee: Gold Star Co., Ltd., Seoul, Rep. of Korea

[21] Appl. No.: 803,453

[22] Filed: Dec. 6, 1991

[30] Foreign Application Priority Data

Dec. 6, 1990 [KR] Rep. of Korea ..... 20001/1990

[51] Int. Cl.[5] ..... F04C 18/04; F04C 29/10

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,415,317 | 11/1983 | Butterworth | 418/142 |
| 4,439,118 | 3/1984 | Iimori | 418/55.5 |
| 4,580,956 | 4/1986 | Takahashi et al. | 418/55.5 |
| 4,597,724 | 7/1986 | Sato et al. | 418/57 |
| 4,836,758 | 6/1989 | Elson et al. | 418/55.5 |

FOREIGN PATENT DOCUMENTS

| | | | |
|---|---|---|---|
| 61-272485 | 12/1986 | Japan | 418/55.5 |

*Primary Examiner*—John J. Vrablik

*Attorney, Agent, or Firm*—Fish & Richardson

[57] ABSTRACT

A scroll-type compressor comprising an eccentricity adjusting bushing interposed between an orbiting scroll member and a driving shaft in order to prevent a radial leakage of a compressed fluid, a driving pin of the driving shaft being received in an inner opening of the bushing, and stoppers for limiting a rotation of the bushing with respect to the pin to a predetermined extent. The stoppers comprise a plane side surface provided at a side of an inner opening of the bushing and a cutoff plane surface provided at a side of the driving pin. The compressor of this invention provides advantage in that opposite directional rotation of the bushing with respect to the driving pin is limited to an angular range by virtue of mutual interference between the stoppers, thereby causing the change of a radius of orbital movement of the orbiting scroll, that is, a change of a distance between centers of the bushing and the driving shaft to be limited to a desired minute range.

2 Claims, 3 Drawing Sheets

SCROLL-TYPE COMPRESSOR WITH ECCENTRICITY ADJUSTING BUSHING

BACKGROUND OF THE INVENTION

1. Field of the Invention

The present invention relates to a scroll-type compressor, and more particularly to a scroll-type compressor provided with an eccentricity adjusting bushing having an inner opening, and a driving pin inserted into the opening, said opening and driving pin each provided with a stopper which is capable of limiting the rotation of the bushing with respect to the driving pin by virtue of mutual interference thereof, thereby limiting a change of radius of the orbital movement of an orbiting scroll within a desired minute range.

2. Description of the Prior Art

Conventionally, a known scroll-type compressor comprises, as described in FIG. 4, a stationary scroll 10 provided thereunder with an involute or spiral-shaped wrap 10*a* and an orbiting scroll 11 provided thereon with a wrap 11*a* of the same shape as that of the wrap 10*a* but having a rotated orientation, said wraps 10*a* and 11*a* engaging with each other in order to provide a compression chamber 5 therebetween. The compressor also includes a driving shaft 1 connecting the orbiting scroll 11 to a motor 12 in order to transmit a driving power from the motor 12 to the scroll 11, thereby causing the scroll 11 to orbit.

In FIG. 4, the reference numeral 13 denotes an airtight case for enclosing the above parts therein.

In operation, upon driving the motor 12, the orbiting scroll 11 rotates by virtue of the driving power having been transmitted from the motor 12 by way of the driving shaft 1 so that the wrap 11*a* of the orbiting scroll 11 orbits continuously about the axis of the wrap 10*a* of the stationary scroll 10 without changing the attitude thereof with respect to the wrap 10*a*, thus the volume of the compression chamber 5 is periodically reduced. Accordingly, a fluid, for example a gaseous refrigerant taken into the compression chamber 5 through a gas intake port 6 and a suction chamber 7, is compressed, then fed to a discharge chamber 8 formed in the center portion of the wrap 11*a* of the stationary scroll 10, and finally discharged through a discharge hole 8*a* formed in the stationary scroll 10.

At this time, the distance between respective centers of the involute spirals of the wraps 10*a* and 11*a* of respective scrolls 10 and 11, that is, the crank radius, is maintained constant in the orbital movement of the orbiting scroll 11.

In addition, the known compressor generally needs to be provided with an eccentricity adjusting bushing for preventing a leakage of the compressed refrigerant gas through two types of clearances generally formed between the wraps 10 and 11. One leak path is axial clearance formed between outermost ends 9 of each wrap 10, 11 and bottom surface 14 of opposite wrap 11, 10 and the other leak path is the radial clearance formed between facing side surfaces of the wraps 10*a* and 11*a*. The eccentricity adjusting bushing is capable of sealing the compression chamber 5 taking account of a counter pressure, thereby preventing a gas leakage in a radial direction. The eccentricity adjusting bushing is rotatably mounted in a hollow shaft downwardly and integrally formed with the orbiting scroll 11.

U.S. Pat. Nos. 4,585,402 and 4,585,403, both published on Apr. 29, 1986, each discloses a representative example of the scroll-type compressor with the above eccentricity adjusting bushing.

As described in FIGS. 2 and 3 showing the construction of the eccentricity adjusting bushing of the scroll-type compressor disclosed in the U.S. patent, the bushing 3 has a cylindrical shape having an inner cylindrical opening 3*a* eccentrically formed therethrough. Thus, the wall thickness of the bushing 3 is not uniform. The bushing 3 is inserted into a cylindrical opening of a downwardly extending shaft 11*b* of the orbiting scroll 11 and rotatably receives a driving pin 2 integrally formed with an upper end of the driving shaft 1.

In the operation of the compressor thus constructed, the compression of refrigerant gas is performed in accordance with the orbital movement of the orbiting scroll 11. At this time, a load arising due to gas compression is transmitted from the shaft 11*b* of the orbiting scroll 11 to the eccentricity adjusting bushing 3, with the loading conditions being as shown in FIG. 3. As shown in the FIG. 3, the load includes two components, one being a radial load, mainly the centrifugal load Fc of the orbiting scroll 11, and the other being a gas compression load Fg, that is, a total reaction load imposing on the wrap 11*a* of the orbiting scroll 11 according to the gas compression, said gas compression load Fg acting on the bushing 3 in a direction at an angle to the acting direction of the radial load Fc.

These load components Fc and Fg act on a center point $O_3$ of the eccentric bushing 3, said point $O_3$ being identified with a center of the orbiting scroll 11. As shown in FIG. 3, these load components Fc and Fg and a resultant load F (=Fc+Fg) act on the center point $O_3$ of the bushing 3 when the orbiting scroll 11 orbits in a clockwise direction.

Here, the eccentricity adjusting bushing 3 rotatably receives, as described above, the driving pin 2 of the driving shaft 1 by means of its opening 3*a* so that the bushing 3 eccentrically rotates on a center point $O_2$ of the driving pin 2, said point $O_2$ being spaced apart from the center point $O_3$ of the bushing 3 in a distance "e". Thus, the resultant load F is capable of producing a moment M about the center point $O_2$ of the pin 2, said moment M being imposed on the bushing 3 and given by:

$$M = F \times e$$

where, the load F' is a divided load of the resultant load F.

Here, the orbiting scroll 11 is engaging with the bushing 3, thus the moment M about the point $O_2$ also acts on the orbiting scroll 11. In result, the moment M acting on the orbiting scroll 11 is capable of producing a force which is capable of radially urging the wrap 11*a* of the orbiting scroll 11 toward the wrap 10*a* of the stationary scroll 10. The urging force is capable of accomplishing the sealing of the compression chamber 5, thereby preventing the above-mentioned radial leakage of the compressed refrigerant gas inside the compression chamber 5 through the radial clearance between the scrolls 10 and 11.

However in the above eccentricity adjusting bushing structure, the sealing effect which is capable of preventing the radial leakage of the compressed gas by virtue of the moment M is considerably influenced by a positional relation between the respective center points, that is, a center point $O_1$ of the driving shaft 1, the center point $O_2$ of the driving pin 2 and the center point $O_3$ (=the center point of the orbiting scroll 11) of the eccentric bushing 3. Hence, the known scroll-type compressor with an eccentricity adjusting bushing has a disadvantage in that it can not limit an excessive eccentric rotation of the eccentricity adjusting bushing on the center point of the driving pin, thereby causing a radius of orbital movement, that is, the distance between the respective centers of the driving shaft and the bushing, said radius of orbital movement being known as an important factor considerably influencing on the compressing effect of the compressor, to excessively change due to the cylindrical structure of the bushing and the driving pin.

SUMMARY OF THE INVENTION

It is, therefore, an object of the present invention to provide a scroll-type compressor with an eccentricity adjusting bushing in which the above-mentioned problem can be overcome and which can prevent a radius of orbital movement or orbiting scroll of the compressor, that is, a distance between a center of a driving shaft and a center of the bushing from excessively changing due to a reaction force generated during the gas compression of the compressor. The present invention limits the changing range of the radius of orbital movement to a desired minute extent which is suited to the sealing purpose.

The above object of this invention can be accomplished by providing a scroll-type compressor comprising: a stationary scroll member having a spiral-shaped wrap; an orbiting scroll member having a spiral-shaped wrap of the same shape as that of said wrap of the stationary scroll member but having its orientation rotated; a compression chamber defined between the wraps of the scroll members; a driving shaft eccentrically connected to the orbiting scroll member for causing the orbiting scroll member to orbit; an eccentricity adjusting bushing interposed between the orbiting scroll member and said driving shaft in order to prevent a radial leakage of a compressed fluid from said compressing chamber and having an inner opening eccentrically disposed therein; a driving pin of said driving shaft being received in the inner opening of said eccentricity adjusting bushing; and means for limiting a rotation of the eccentricity adjusting bushing with respect to said driving pin to a predetermined extent, whereby opposite directional rotation of the eccentricity adjusting bushing with respect to the driving pin being limited to an angular range by virtue of said means for limiting the rotation of the bushing, and change of a radius of orbital movement of the orbiting scroll, that is, change of a distance between centers of the eccentricity adjusting bushing and the driving shaft being limited to a desired minute range.

BRIEF DESCRIPTION OF THE DRAWINGS

The above and other objects, features and other advantages of the present invention will be more clearly understood from the following detailed description taken in conjunction with the accompanying drawings, in which:

FIGS. 1A and 1B are cross-sectional views showing a combination structure of an eccentricity adjusting bushing and a driving pin for a scroll-type compressor in accordance with this invention, in which:

FIG. 1A is a view showing the structure of the bushing and the driving pin; and FIG. 1B is a view showing an operational state of the structure of FIG. 1A;

DETAILED DESCRIPTION OF THE PREFERRED EMBODIMENTS

Figure 1A:
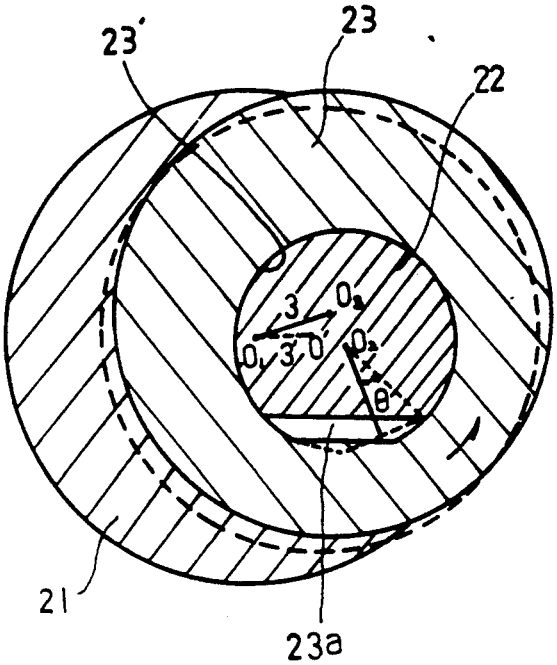
Figure 1B:
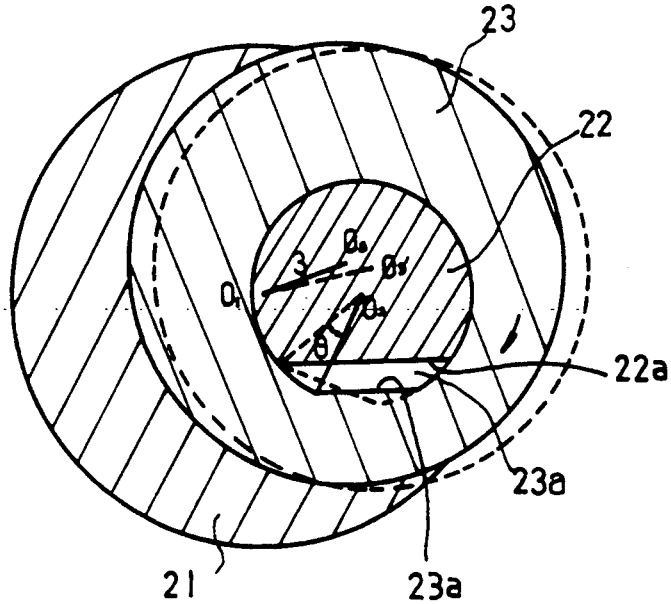
Figure 3:
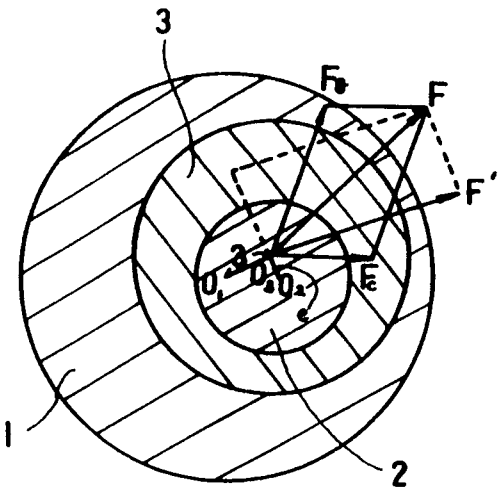
FIG. 3 PRIOR ART
FIG. 3 is a cross-sectional view corresponding to FIG. 1B, but showing the prior art.
Figure 2:
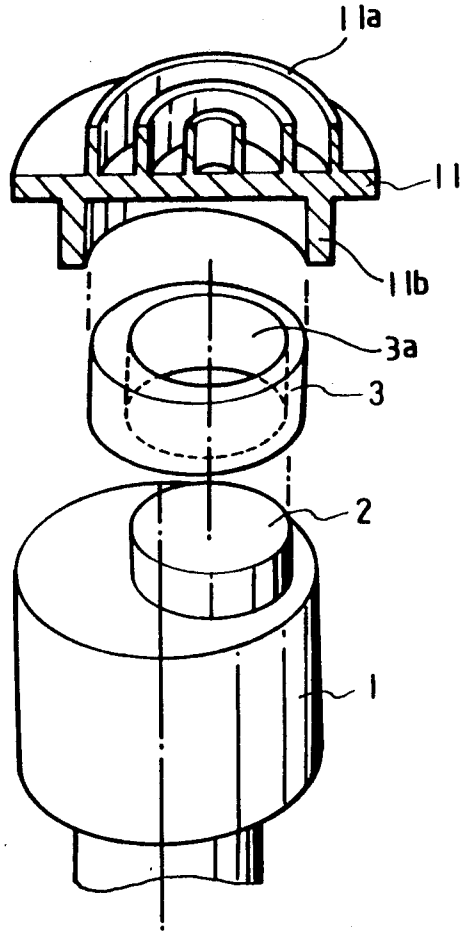
FIG. 2 PRIOR ART
FIG. 2 is an exploded perspective view of a construction of an orbiting scroll, an eccentric bushing and a driving shaft for a scroll-type compressor according to the prior art.
Figure 4:
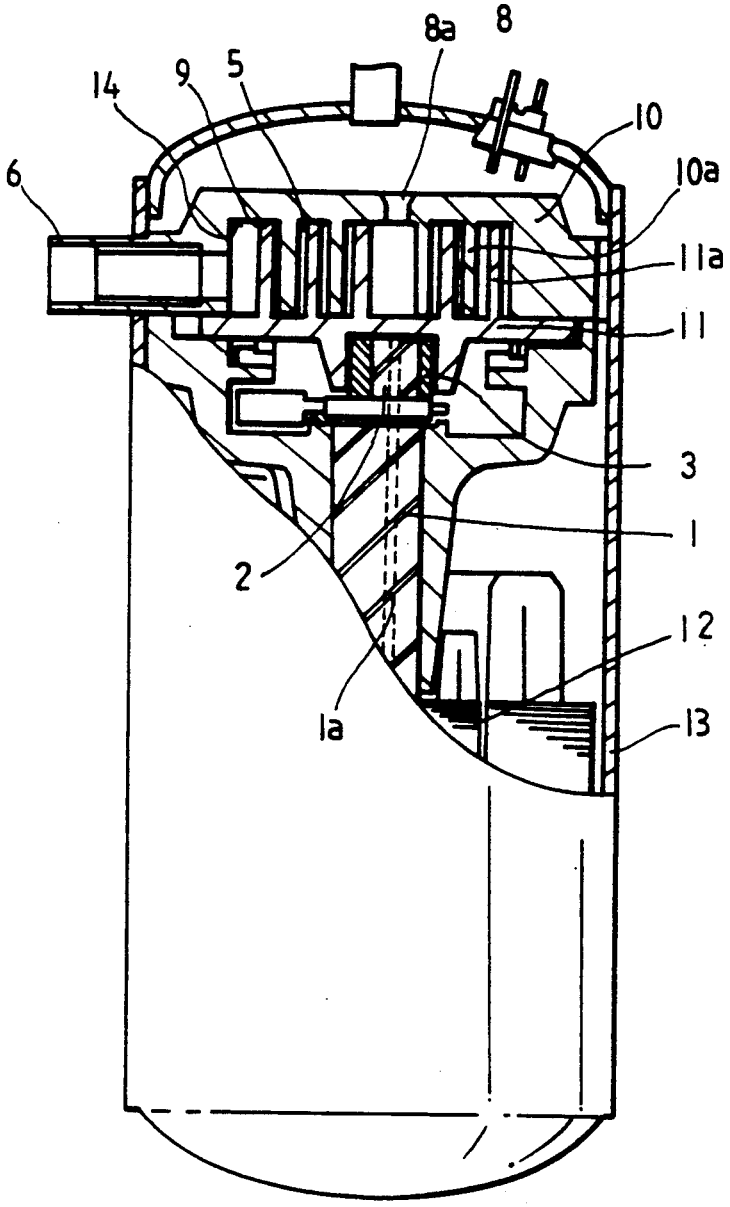
FIG. 4 PRIOR ART
FIG. 4 is a partially broken elevational view showing a construction of the scroll-type compressor according to the prior art.

Referring first to FIGS. 1A and 1B which are sectional view showing 1) a combination structure of an eccentricity adjusting bushing and a driving pin for a scroll-type compressor according to this invention and 2) a sectional view showing an operational state of the structure of FIG. 1A, respectively. The compressor is provided with the driving pin 22 which is integrally formed with an upper end of a driving shaft 21 and the eccentricity adjusting bushing 23 which receives the driving pin 22 by means of an inner opening 23' eccentrically disposed therein.

On the other hand, the scroll-type compressor of this invention has the similar elements to those of the above-described known compressor except for the structures of the driving pin 22 and the eccentric bushing 23, thus the similar elements are not shown in FIGS. 1A and 1B, however, the similar elements will be described as having the same reference numerals as those of the elements of the known compressor.

As shown in the drawings, the driving pin 22 and the bushing 23 each has a stopper for limiting the opposite directional rotation of the bushing 23 with respect to the driving pin 22. In other words, the driving pin 22 has a cutoff plane surface **22*a* at a side thereof, while the bushing 23 is provided with a plane side surface 23'*a* at an inner side surface of the inner opening 23' thereof. Thus, the driving pin 22 and the opening 23' of the bushing 23 have a partially crescent-shaped cutoff part and a partially crescent-shaped remaining part, respectively, and the pin 22 and the bushing 23 each has a truncated circular cross sectioned shape, said cutoff part of the pin 22 being a space part remaining from excepting the solid part of the pin 22 from an assumed cylinder having a radius of the pin 22, and said remaining part of the busing 23 being a solid part remaining from excepting the opening 23' from an assumed cylinder having a radius of the opening 23'**.

Here, the driving pin 22 is so machined that the cross-sectioned area of the partially crescent-shaped cutoff part thereof is larger than that of a partially crescent-shaped remaining part of the bushing 23. Thus, as the driving pin 22 is inserted into the opening 23' of the bushing 23 in order that the plane surfaces **22*a* and 23'*a* of the pin 22 and the bushing 23 face each other, there is provided a space 23*a* between the surfaces 22*a* and 23'*a*, as shown in FIGS. 1A and 1B**.

In the operation of the compressor provided with the bushing structure thus constructed, the gas compression produces a reaction load, that is, a gas compression load imposing on the orbiting scroll 11. In addition, the reaction load and a centrifugal load of the orbiting scroll 11 commonly act on a center $O_3$ of the eccentricity adjusting bushing 23 in order to cause the bushing 23 to eccentrically rotate on the center $O_2$ of the driving pin 22, as above described in the description of the prior art.

Thus, the eccentric bushing 23 only rotates with respect to the driving pin 22 within a predetermined extent of angle by virtue of a mutual interference between the stoppers of the driving pin 22 and the bushing 23, that is, the cutoff side surface 22*a* of the driving pin 22 and the plane side surface 23'*a* of the bushing 23.

In other words, upon counterclockwise rotation of the bushing 23 with respect to the driving pin 22, the bushing 23 only rotates to an angle of $\Theta$ due to mutual interference of the plane surfaces 22*a* and 23'*a* of the pin 22 and the bushing 23 as described in FIG. 1A. At this time, the radius of orbital movement, that is, the distance $\epsilon$ between the center $O_1$ of the driving shaft 21 and the center $O_3$ of the bushing 23 changes from $\epsilon$ into $\epsilon'$. Hence, it is assured that the rotation of the bushing 23 with respect to the driving pin 22 is limited, thereby preventing the distance $\epsilon$ from changing to be shorter than a predetermined minimum reference distance, that is, the shortest distance $\epsilon'$.

On the contrary, upon clockwise rotation of the bushing 23 with respect to the driving pin 22, the bushing 23 also rotates to the angle of $\Theta$ due to the mutual interference between the plane surfaces 22*a* and 23'*a* as described in FIG. 1B. At this time, the distance $\epsilon$ between the center $O_1$ of the driving shaft 21 and the center $O_3$ of the bushing 23 changes from $\epsilon$ into $\epsilon''$. Thus, it is assured that the rotation of the bushing 23 with respect to the driving pin 22 in this case is efficiently limited in order to prevent the distance $\epsilon$ from being longer than a predetermined maximum reference distance, that is, the longest distance $\epsilon''$.

Accordingly, the structure of the partially crescent-shaped parts of the driving pin 22 and the bushing 23 causes the bushing 23 to rotate with respect to the driving pin 22 within an angle of $2\Theta$, thereby efficiently limiting the change of the radius $\epsilon$ of the orbital movement within a changing extent given by:

$$\epsilon' < \epsilon < \epsilon''$$

On the other hand, the rotation of the bushing 23 with respect to the driving pin 22 is capable of compensating the compressor for formation of a clearance between the wraps 10*a* and 11*a* of the scrolls 10 and 11, thereby accomplishing a sealing of the compression chamber 5 of the compressor. In other words, if there is a clearance between the wraps 10*a* and 11*a* due to a machining error in machining the wraps 10*a* and 11*a* so that there may be a gas leakage through the clearance, the eccentricity adjusting bushing 23 may rotate with respect to the pin 22 in the clockwise direction as described in FIG. 1B, thereby causing the radius of orbital movement to be increased, that is, causing the distance $\epsilon$ between respective centers of the driving shaft 21 and the eccentric bushing 23 to be longer. In result, the orbiting scroll 11 having the same center as that of the bushing 23 also moves with respect to the stationary scroll 10 according to the change of distance $\epsilon$, thereby causing the clearance between the wraps 10*a* and 11*a* to be reduced to a desired extent. On the contrary, if the orbital movement of the orbital scroll 11 is not normally performed due to a frictional force generated by an obstacle interposed between the wraps 10*a* and 11*a*, the bushing 23 rotates with respect to the pin 22 in the counterclockwise direction as described in FIG. 1A, thereby causing the radius $\epsilon$ of the orbital movement to be reduced. In result, the limited rotation of the bushing 23 efficiently provides the compressor with a desired sealing of the compression chamber 5.

As described above, the present invention provides a compressor with a combination structure of an eccentric bushing and a driving pin, each having a partially crescent-shaped part, which can limit the opposite directional rotation of the bushing with respect to the pin to a predetermined minute angle range by virtue of the mutual interference of the partially crescent-shaped parts of the bushing and the driving pin. Thus, the compressor of this invention provides an advantage in that the bushing 23 rotates at a limited angle in opposite directions in order to efficiently restrain a formation of clearance and a generation of friction between the wraps of the scrolls, thereby accomplishing the sealing of the compressing chamber and improving the operational effect of the compressor. In addition, the compressor of this invention provides another advantage in that it is provided with a space between an inner opening of the bushing and the driving pin inserted into the inner opening, thereby improving the assemblage convenience of the compressor.

Although the preferred embodiments of the present invention have been disclosed for illustrative purpose, those skilled in the art will appreciate that various modifications, additions and substitutions are possible, without departing from the scope and spirit of the invention as disclosed in the accompanying claims. For example, even though it has been described that the stoppers for limiting a rotation of the eccentricity adjusting bushing 23 with respect to a driving pin 22 to a predetermining extent, comprises the cutoff plane surface 22*a* and the plane side surface 23'*a* which cause each cross-sectioned shape of the driving pin 22 and the inner opening 23' of the bushing 23 to be a truncated circular shape. However, other types of stoppers may be used so long as providing the same effect of limiting the rotation of the bushing 23 with respect to the driving pin 22 to a desired rotation angle.

What is claimed is:

1. A scroll-type compressor comprising:

a stationary scroll member having a spiral-shaped wrap;

an orbiting scroll member having a spiral-shaped wrap of the same shape as that of said wrap of the stationary scroll member but having a rotated orientation;

a compression chamber defined between the wraps of the scroll members;

a driving shaft eccentrically connected to the orbiting scroll member for causing the orbiting scroll member to orbit;

an eccentricity adjusting bushing interposed between the orbiting scroll member and said driving shaft in order to prevent a radial leakage of a compressed fluid from said compression chamber and having an inner opening eccentrically disposed therein;

a driving pin of said driving shaft being received in the inner opening of said eccentricity adjusting bushing; and means for limiting a rotation of the eccentricity adjusting bushing with respect to said driving pin to a predetermined extent, said means comprising a plane side surface provided at a side of said inner opening of the eccentricity adjusting bushing and a cutoff plane surface provided at a side of the driving pin, whereby said driving pin being provided with a partially crescent-shaped cutoff part and said bushing being provided with a partially crescent-shaped remaining part, said plane surfaces being spaced from each other to allow relative rotation between the driving pin and the eccentricity adjusting bushing, and whereby opposite directional rotation of the eccentricity adjusting bushing with respect to the driving pin being limited to an angular range by virtue of said means for limiting the rotation of the bushing, and change of a radius of orbital movement of the orbiting scroll, that is, change of a distance between centers of the eccentricity adjusting and the driving shaft being limited to a desired range.

2. A scroll-type compressor comprising:

a stationary scroll member having a spiral-shaped wrap;

an orbiting scroll member having a spiral-shaped wrap of the same shape as that of said wrap of the stationary scroll member but having a rotated orientation;

a compression chamber defined between the wraps of the scroll members;

a driving shaft eccentrically connected to the orbiting scroll member for causing the orbiting scroll member to orbit;

an eccentricity adjusting bushing interposed between the orbiting scroll member and said driving shaft in order to prevent a radial leakage of a compressed fluid from said compression chamber and having an inner opening eccentrically disposed therein;

a driving pin of said driving shaft being received in the inner opening of said eccentricity adjusting bushing; and means for limiting a rotation of the eccentricity adjusting bushing with respect to said driving pin to a predetermined extent, said means comprising a plane side surface provided at a side of said inner opening of the eccentricity adjusting bushing and a cutoff plane surface provided at a side of the driving pin, whereby said driving pin being provided with a partially crescent-shaped cutoff part and said bushing being provided with a partially crescent-shaped remaining part, wherein said partially crescent-shaped cutoff part of the driving pin has a larger cross-sectional area than that of the partially crescent-shaped remaining part of the eccentricity adjusting bushing so that a space is provided between the driving pin and the bushing, whereby opposite directional rotation of the eccentricity adjusting bushing with respect to the driving pin being limited to an angular range by virtue of said means for limiting the rotation of the bushing, and change of a radius of orbital movement of the orbiting scroll, that is, change of a distance between centers of the eccentricity adjusting and the driving shaft being limited to a desired range.

* * * * *